US010160136B2

(12) United States Patent
Scorcia

(10) Patent No.: US 10,160,136 B2
(45) Date of Patent: Dec. 25, 2018

(54) SYSTEM AND METHOD FOR BENDING WOOD STRIPS

(71) Applicant: Bennett Vito Scorcia, Westfield, NJ (US)

(72) Inventor: Bennett Vito Scorcia, Westfield, NJ (US)

( * ) Notice: Subject to any disclaimer, the term of this patent is extended or adjusted under 35 U.S.C. 154(b) by 412 days.

(21) Appl. No.: 14/918,460

(22) Filed: Oct. 20, 2015

(65) Prior Publication Data

US 2016/0107328 A1 Apr. 21, 2016

Related U.S. Application Data

(60) Provisional application No. 62/065,956, filed on Oct. 20, 2014.

(51) Int. Cl.

| | |
|---|---|
| ***B27H 1/00*** | (2006.01) |
| ***B27K 1/02*** | (2006.01) |
| ***B27K 5/00*** | (2006.01) |

(52) U.S. Cl.

CPC ..... *B27H 1/00* (2013.01); *B27K 1/02* (2013.01); *B27K 5/001* (2013.01)

(58) Field of Classification Search

CPC ... B27H 1/00; B27H 5/00; B27K 1/00; B27K 1/02; B27K 5/001; B27D 1/086

USPC ..... 144/269, 270, 271, 381

See application file for complete search history.

(56) References Cited

U.S. PATENT DOCUMENTS

| | | | | |
|---|---|---|---|---|
| 2,296,781 A * | 9/1942 | Farny | B27D 1/086 | 138/144 |
| 4,469,156 A * | 9/1984 | Norimoto | B27H 1/00 | 144/254 |
| 6,705,060 B1 * | 3/2004 | McGuinness | B65B 25/24 | 53/204 |

* cited by examiner

*Primary Examiner* — Matthew G Katcoff
(74) *Attorney, Agent, or Firm* — Winston & Strawn LLP

(57) ABSTRACT

A system and method for automated bending of wood strips. The system includes an preprogrammed automated robot arm that is fitted with a gripper for grasping and manipulating the wood board around a hot mandrel in order to bend the wood into intricate bent shapes. The wood strips are first soaked in water so that they pliable to bend around the mandrel. The heated mandrel plasticizes the lignin to allow the fibers to reorient in the wet wood strips thus fixing or locking the wood in the bent shape. The grippers are preferably pneumatic grippers formed from two plates that move towards each other to grasp or clamp onto the wood strip. A friction plate urges the wood strips against the heated mandrel to provide consistent and constant contact between the wood strip and the surface of the hated mandrel.

17 Claims, 8 Drawing Sheets

BENDING IN PLAN VIEW

BENDING IN ELEVATION VIEW

ELEVATION

ELEVATION
PERSPECTIVE

PLAN

PLAN
PERSPECTIVE

SYSTEM AND METHOD FOR BENDING WOOD STRIPS

FIELD OF THE INVENTION

The present invention generally relates to systems and methods for bending of woods and more particularly to systems and methods for the automated bending of wood strips using a programmed robotic arm and a heated mandrel.

BACKGROUND OF THE INVENTION

Traditional systems and methods for bending wood involved complex systems of clamps and/or forms. For example, in U.S. Pat. No. 4,771,281 a curved wood bending machine is disclosed for bending solid, veneered or laminated wooden members. The machine has a support frame with a generally planar top member on which a plurality of guide rails are connected in predetermined circumferential relationship and radial planes from a common counterpoint on the top member. Clamping assemblies are slidably mounted on the guide rails and can be moved on the guide rails to predetermined positions relative each other. The clamping assemblies have a fixed vertical shoe and a coacting movable shoe which is activated by a pneumatically operated cylinder and plunger arrangement so that a desired curvature can be established to fit and bend an elongated wooden member therein. Locking members to prevent accidental movement of the clamping assemblies after they are set for the predetermined shape for bending the wooden member.

Similarly, U.S. Pat. No. 6,330,894 discloses a form, a jig, for bending wood. The jig disclosed in this patent is particularly advantageous for bending wood in the construction of custom spiral staircases. The jig comprises a trunk and multiple arms. Each of the arms has an inner end portion releasably attached to the trunk and an outer arm portion adapted to removably attach the wooden board thereto. When the wooden board is attached to the outer end portions of the arms, the wooden board is bent to conform to a curve defined by the end portions of the arms as it extends up, and around the trunk. The trunk and arms are preferably cylindrical tubes. The arm portions that attach to the trunk are split cylinders that may be locked on the trunk with a bolt. Each arm includes an inner cylindrical tube which slides within an outer cylindrical tube so that the outer end portion of the arm may be locked at a selected radius from the trunk so that the jig may be used to bend boards at varying radiuses.

The use a hot mandrel to assist in the bending of wood is more than a century old. As described in U.S. Pat. No. 186,779, hot air or steam, is passed through a pip (mold) to heat it up. A piece of wood, e.g., an umbrella stick, that is already in a softened and moist condition, is passed in between a series of clamps. Levers are used to moved and firmly hold and bend the wood around the mold. The heat of the mold dries the wood thoroughly and cures the same by softening the resinous materials in the wood. This allows the compressed fibers to rearrange themselves, so that when the curing operation is completed the bent wood is firmly set in its shape.

Despite this general knowledge, there is a need for improved and enhanced production processes and systems for bending wood and these are now provided by the present invention.

SUMMARY OF THE INVENTION

The present invention is an automated system and process for bending wood, particularly for creating helically shaped strips of wood. The system includes an automated robot arm that is programmed by the user, artisan, to perform the desired specific bends in the wood. The robot arm is fitted with a gripper for grasping and manipulating the wood strip around a hot mandrel in order to bend the wood into intricate bent shapes.

The wood strips, essentially of any size or length, and of any cross section (e.g., rectangular, circular, oval or elliptical) are soaked so that they are pliable to bend around the mandrel. Thus, in addition to rectangular wood strips, rods, half round wood strips and wood tubes can be bent around the mandrel. For rounded shapes, the mandrel can be configured to receive and support at least half of the circumference of the rod or tube. The bending time may be slower to allow the heat to permeate the entire rod or tube. The mandrel is heated so in order to dry and reorients the fibers in the wet wood strips thus fixing or locking the wood in the bent shape. Although the mandrel is typically cylindrical, conical or other shaped mandrels can be used.

The gripper portion of the robot arm grasps the wood strip (at the end of the strip at the beginning of the process) and moves it around the mandrel in an involute spiral. In the inventive process, the wood is bent around the mandrel at an angle with respect to the mandrel (rather than being directly perpendicular). The robot arm can orient and rotate the wood on a precise and preprogrammed helical axis. This inventive type of wood bending is useful to create furniture or other structural or architectural objects.

The resulting shape of the bent wood can vary depending upon the initial arrangement of the wood strip. For a flat relatively straight wood strip, the result is a somewhat spiral curved shape. The same shape can be achieved by bending a wood strip that is formed in the shape of an arc. Again, bending around the mandrel converts that shape to a spiral shape. In both instances the wood strip is bent around the mandrel at an angle rather than strictly perpendicular to the surface for the mandrel. Yet another way to achieve the same spiral shape is to start with a curved wood strip and make perpendicular bends around the mandrel in multiple locations along the strip.

The grippers are preferably pneumatic grippers formed from two plates that move towards each other to grasp or clamp onto the wood strip. The thickness of the wood strip is not critical, although typically it is in the range of $1/16^{th}$ to 1 inch in thickness. The width of the strips that can be bent is governed by the size of the mandrel. Similarly, with the appropriate sized mandrel, theoretically there is no practical limit to the thickness of wood that can be bent. The wood can be of any thickness, although the time for soaking of the wood and the handling of large wood strips or beams requires larger equipment. The use of automated equipment and in particular robots enables the larger wood strips to be easily handled. Of course, the mandrel must be sized accordingly to process the larger size wood, with a larger radius of the mandrel being necessary. In particular, the mandrel must be sufficiently sized and made of sufficient strength to contact and bend the entire width of the wood strip.

The length of the wood strip can be as long as practical or desired, but it can theoretically be infinite. The angle that the wood makes with the mandrel during bending process is preferably between 30° and 150°. As noted above, the wood needs to be wetted at least in the area where it is to be bent. In one embodiment, only portions of the wood strips are actually bent and the ends of the wood strip would not pass each other. In this embodiment, the ends of the wood form preferably an angle of about 135° with respect to each other after being bent. This angle of course is preferred and for another embodiment can be 90° to bend one end of the wood over the other to form a U-shaped bent part. The use of angles of other than 90° creates more unusual bent wood configurations. It is certainly possible to use any angle above 0 or less than 180° although the preferred range is between 30 and 150°. Also, the ends of the wood strip can pass each other for additional configurations. For example, several passes of the wood strips around the mandrel can be performed to create helical geometries. There can be spaces between the helical geometry or the strips can be adjacent each other to form a tube. The specific final shape of the bended wood strips can be varied and are selectable based on the desires of the party bending the wood. The intended use of the bent wood material may dictate the final shape. It is important to bend greater than desired because the material relaxes as it dried. This can be accounted for by measuring the difference between programmed bend angle and actual bend angle.

Incremental bends to create apparently continuous curving strips similar to the shape of the letter S can be achieved by several small bends formed close together. The incremental bends can include small non-bent areas or wood portions between the bent portions. These can be controlled as desired but typically the incremental bends mimic a continuous bend except that the incremental bends include linear portions between each curved or bent portion.

The bending time is relatively quick as it takes only approximately two minutes to bend a ⅜th inch thick wood strip around the mandrel. Red Oak is a preferred wood material for this purpose. For this thickness, it takes approximately another two minutes for the wood to dry and be fixed in the shaped position. A skilled artisan can readily determine the appropriate bending and drying times for any thickness and type of wood. Bending time can also be determined by a pressure sensor configured with the robotic arm. Also a cylindrical mandrel of appropriate size can be selected to achieve the desired shape after bending. The pipe is heated to a temperature that is well above that needed to dry the moisture from the wood. The bending and heating or drying time varies depending upon which specific temperature and wood species is used.

The process and system of the present invention for bending wood into a bent structure, is characterized in that it grasps a water saturated wood strip by a holding member; contacts the held water saturated wood strips with a heated mandrel for a sufficient time and with sufficient pressure to reorient the fibers in the water saturated wood strips to fix or lock the wood strip in a desired bent configuration. When wood is heated, the lignin, which is the glue like substance in wood, plasticizes to allow the fibers to reorient. The user of the system can tell when the wood has been dried because it changes from a darker wet-looking color to a lighter, whiter dry-looking one. This visual verification is sufficient to determine when the bending operation is complete. Also, after bending the wood has a springy type of memory such that it can relax and return to a more open position than to the extent that it was bent. To compensate for this, the wood must be bent beyond the desired final position so that after it relaxes it will assume the appropriate position. A skilled artisan can conduct routine tests to determine how much relaxation occurs and how far the wood must be bent beyond the desired final position in order to account for relaxation. Once the moisture content of the wood is reduced to about 2-4%, the fibers are fixed and cannot be reoriented again) After the bending is complete, the wood that is fixed or locked in the bent configuration can be removed from the machine. The grasping, contacting and removing steps are automatically conducted under computer control of the holding member and mandrel to obtain the bent structure.

The process and system of the present invention are further characterized in that the water saturated wood strip is obtained by soaking the wood in water for a sufficient time to saturate the wood fibers therein and render the wood strip pliable and conducive to being bent. In a preferred embodiment of the present invention, the mandrel is heated to a temperature of between approximately 150° F. and 380° F.

The holding member is a preprogrammed automated robot arm that is fitted with a gripper for grasping and manipulating the wood strip around the heated mandrel in order to bend the wood into the desired bent configuration.

The process and system of the present invention are further characterized in that the holding member is a movable clamp that engages the wood strip and advances it towards the heated mandrel, wherein the contacting of the wood strip with the mandrel is achieved by a swing arm or friction plate that directs the wood strip towards and against the heated mandrel with consistent and constant force.

The system of the present invention includes a holding member for grasping a water saturated wood strip; a heated mandrel for contacting the held water saturated wood strips for a sufficient time and with sufficient pressure to reorient fibers in the water saturated wood strips to fix or lock the wood strip in a desired bent configuration. The system further includes control circuitry coupled to the holding member, the control circuitry controlling the operation of the system. The control circuitry is operable to cause the holding member to automatically grasp the wood strip, cause contact with the heated mandrel and remove the wood strip after it is fixed or locked in the bent configuration to obtain the bent structure.

In a preferred embodiment, the holding member is a movable clamp that engages the wood strip and advances it towards the heated mandrel, wherein the contacting of the wood strip with the mandrel is achieved by a swing arm or friction plate that directs the wood strip towards and against the heated mandrel with consistent and constant force.

The present invention also encompasses a structural element comprising a bent wood structure having non-linear features and a predetermined curved configuration.

BRIEF DESCRIPTION OF THE DRAWINGS

For the purposes of illustrating the present invention, there is shown in the drawings a form which is presently preferred, it being understood however, that the invention is not limited to the precise form. The appended drawing figures provide additional details of the invention, wherein.

DETAILED DESCRIPTION OF THE INVENTION without the need for complex custom molds, yielding three-dimensional structural matrix of natural timber. The present invention combines traditional wood bending techniques with digital tools practices to produce a highly articulated system. This unique building technology encompasses computation, material research, and computer-aided manufacturing, opening up a non-linear dialogue between actors and parameters. The present invention's combination of the traditional art of hot iron bending with robotic automation has produced unexpected behaviors that lead those skilled in the art to new forms and potentials. The wood bending process, form generation and robot code create a feedback loop in which material exploration informs updated code for generating and analyzing geometries, and the subsequent robotic operations. Ultimately these insights reveal the process as materially efficient and geometrically versatile to an degree previously unknown in the art.

Figure 1:
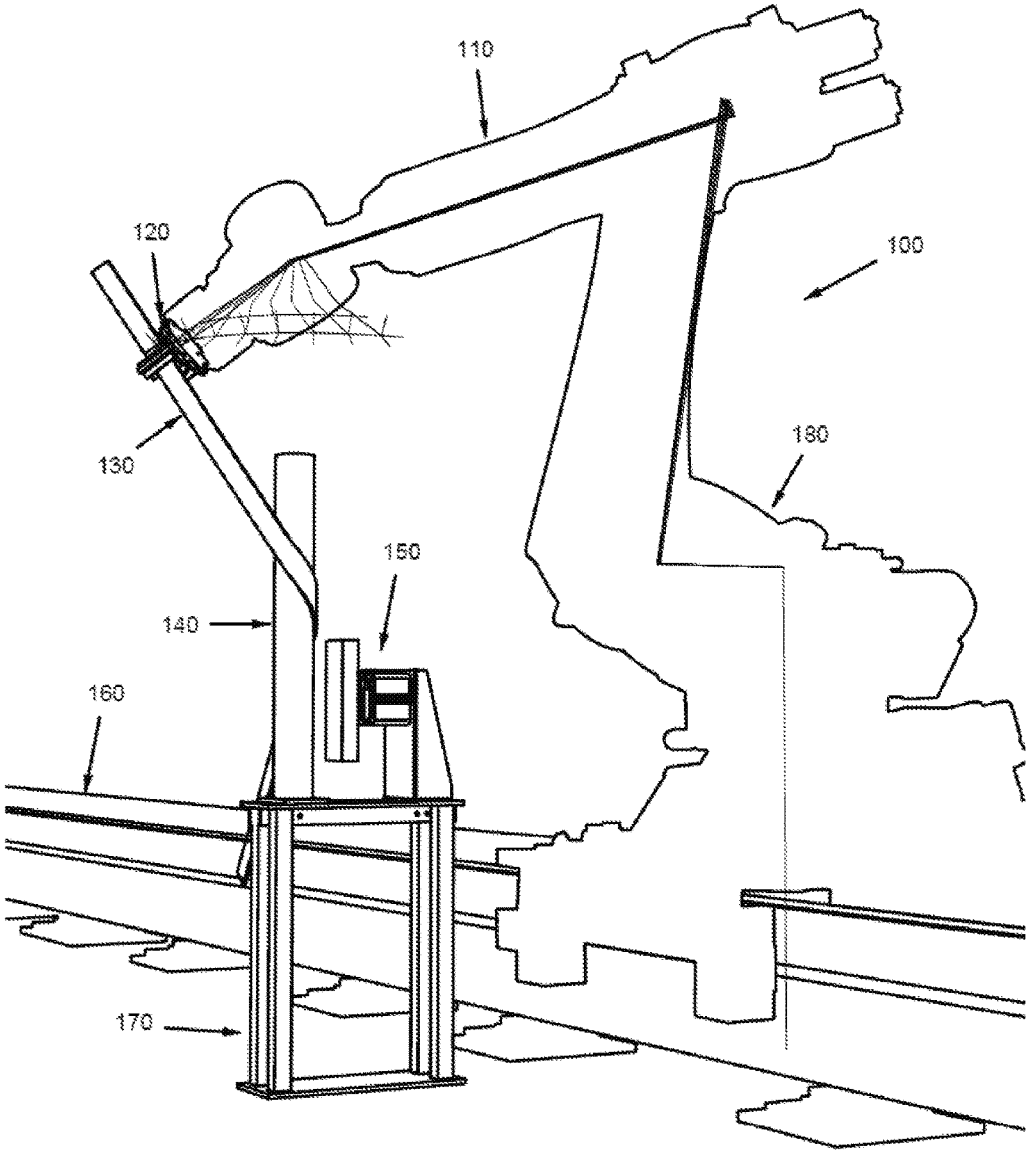
FIG. 1 depicts a perspective view of the components of a system of the present invention.

FIG. 1 depicts an illustrative preferred embodiment of the present invention which includes a robotic system. As shown in this Figure, the system 100 is comprised of several parts, including a robotic arm 110 that is attached to a base 180 mounted on a rail 160, a gripper 120 formed at the end of the arm 110, a mandrel 140 and a friction plate 150 mounted on a base 170. As illustrated in FIG. 1, the gripper 120 grasps a portion of a wood strip 130 in order to manipulate the strip 130 about the mandrel 140. One surface of the strip 130 faces and contacts the mandrel 140 while the friction plate 150 applies force to the opposite face of the strip 130. The urging of the friction plate on the strip 130 insures constant and consistent contact of the strip 130 with the mandrel 140. As further described below, the movement of robotic arm 110 is preprogrammed to move the strip 130 with respect to the mandrel in order to create the predetermined bends in the strip 130. In a preferred embodiment, the robot is a 6-axis robot, for example as provided by Kuka™.

Figure 2:
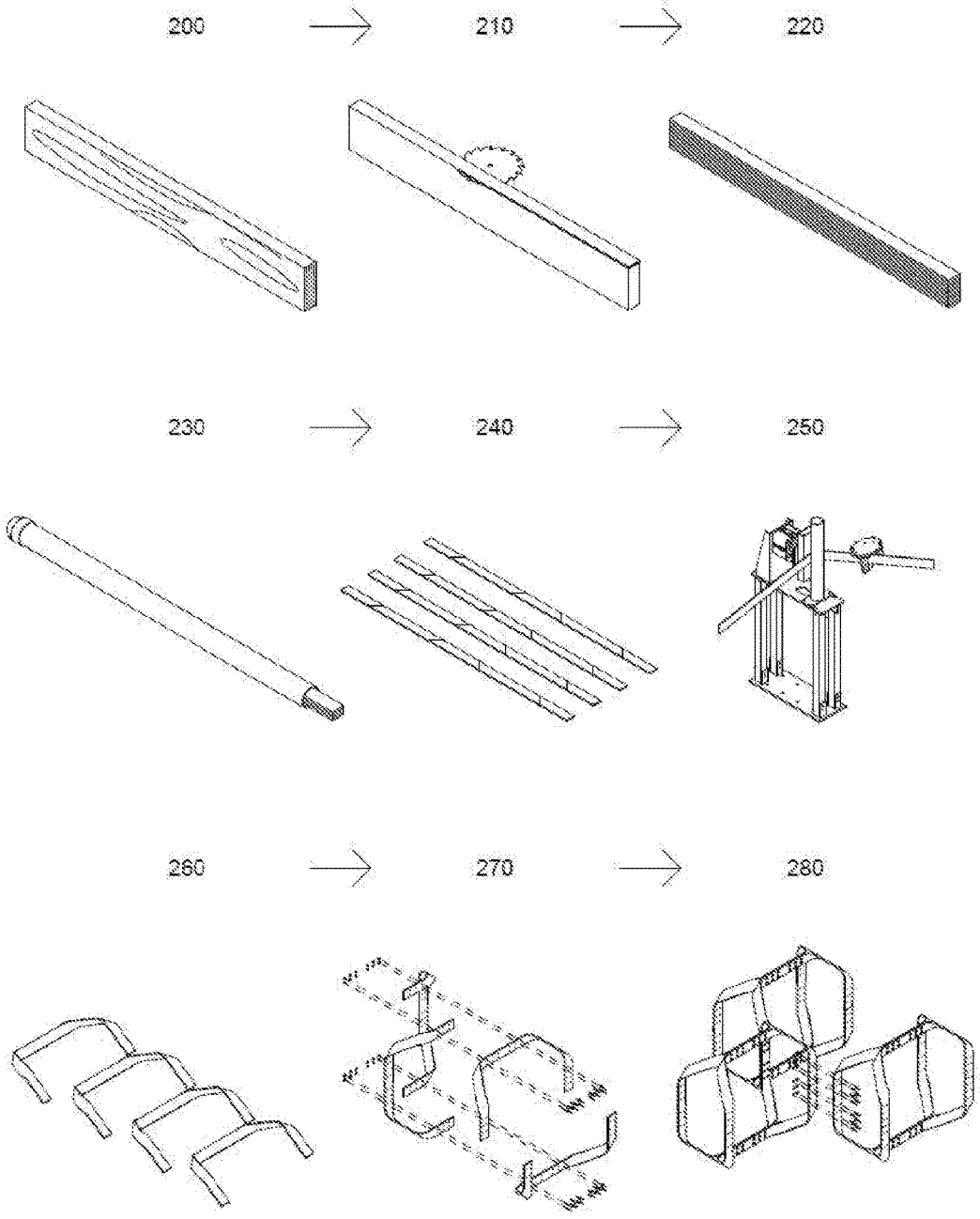
FIG. 2 illustrates an exemplary method of the present invention.

FIG. 2 illustrates an overall process of an embodiment of the present invention. The process begins with providing rift sawn timber (step 200). In rift sawn boards, the boards are cut radially from the logs so the annual rings are nearly 90° to the face of the timbers. When rift-sawn, each timber is cut along a radius of the original log, so that the saw cuts at right angles to the tree's growth rings. Quarter sawn or plain sawn boards can be used, but are not as preferable because the best results are obtained by bending the wood perpendicular to the grain. If desired, a skilled artisan can conduct routine bending tests on non-rift sawn wood to determine whether it can be bent into the desired configurations. As described above, the rift sawn boards are typically large in dimension and, in step 210, are re-sawn to provide the desired thickness strips 130 as shown in step 200. As described above, the thickness of the boards 130 can range in size from $1/16^{th}$ up to one or two inches. In a preferred embodiment, the thickness is preferably between ⅛ and ⅜ inches. Below 1/16th inch in thickness, there is insufficient material to provide structural stability—i.e., the boards are subject to breaking. The process is scalable and above $3/8^{th}$ in thickness, adjustments to the bending time, drying time and heat varies based on wood species, wood density and material thickness such that the center of the boards are sufficiently heated to initiate the structural changes (described below) to enable bending, without burning the outer portions of the boards.

In step 230, the strips 130 are placed in a water bath in order to facilitate the bending process. Although all boards 130 will have some degree of moisture content, the soaking process ensures a uniformity of the moisture content required for the bending process. Soaking the material prior to bending reduces the possibility of burning, and softens the lignin in the stock 130 for more desirable results. The wood is held under water in a tank or other vessel for a time sufficient to saturate the wood. The moisture content can be measured with a moisture content meter. For ⅜" Red Oak, the boards are soaked for approximately 10-20 hours prior to bending. The soak time varies depending on the age of the wood, the thickness, the type of wood (species, densities, etc.). As described above, Red Oak is a preferred wood due to its hardness, durability, elasticity and consistency in grain, among other factors. As shown in FIG. 2, in one embodiment of the method of the present invention, a plurality of the wood strips 130 are placed in a pipe, which can be polyvinylchloride (PVC), which is then filled with water and capped. Other liquids and chemicals can be used to plasticize wood but water works fine and is non-toxic. A by-product of soaking the wood in the above described manner is that it generates pitch that can be collected and used as a fuel for other purposes. As such, as an alternative to the process of step 230, one would only need to soak the areas undergoing bending.

The artistic aspect of the present invention is primarily invoked in step 240. Knowing how he or she wants the final product to appear, the artisan plans out how the individual pieces of wood need to be bent. In a preferred embodiment, this is all accomplished directly on a computer. Software is used to translate the artist's 3D geometric shapes into robotic code for manufacturing. Turning to the illustration in step 280, the artisan envisions the final product. From this vision, the software determines the number of pieces of wood 130 required bending information to drive the manufacturing process. The process is able to bend wood in orientations that are not common to produce bent wood products and structures that are unusual, aesthetic and functional. The robot guides wood 130 vertically as strip rotates around turning mandrel 140 and the robot keeps constant pressure between the mandrel 140 and the wood strip 130.

Once the artisan has worked out the geometries of the bends for the individual strips of wood 130, she is then able to transfer those geometries into programming of movements for the robotic arm 110. Software is used to convert the artisan's 2D or 3D information for the final product into machine code. The geometries are translated into orientation and bending operations for the 6-axis robot 110. The multiple axes allow the art to achieve many different positions corresponding to a smooth motion that moves the soaked wood against the mandrel along an involute path. This set of kinematics generates a complex and interlinked geometric form through an aggregation of bent wood modules. This allows multiple robots to interact with each other opening up even more variety of complex bents. In this configuration, robots can be fitted with three types of arm end tools, i.e., 1. heated mandrel 140, 2. gripper 120/friction plate 150 and 3. heated gripper 120, which is a combination of heated mandrel 140 and gripper 120.

Once the programming has been complete, the actual bending process occurs in step 250. The bending process is described more fully below. After the bends have been completed, the wood strips 130 are preferably air dried to remove any excess moisture induced in step 230. Although the air can be heated to assist in the drying process, care must be taken that the heat is not too great to undo the bends just formed. In steps 270 and 280, the individual wood strips 130 are fastened together and assembled into the final product. Fastening via pop rivets is a preferred method of assembly, but glue, and finger joint designed into wood strips 130 can be used for joining strips 130.

Figure 3:
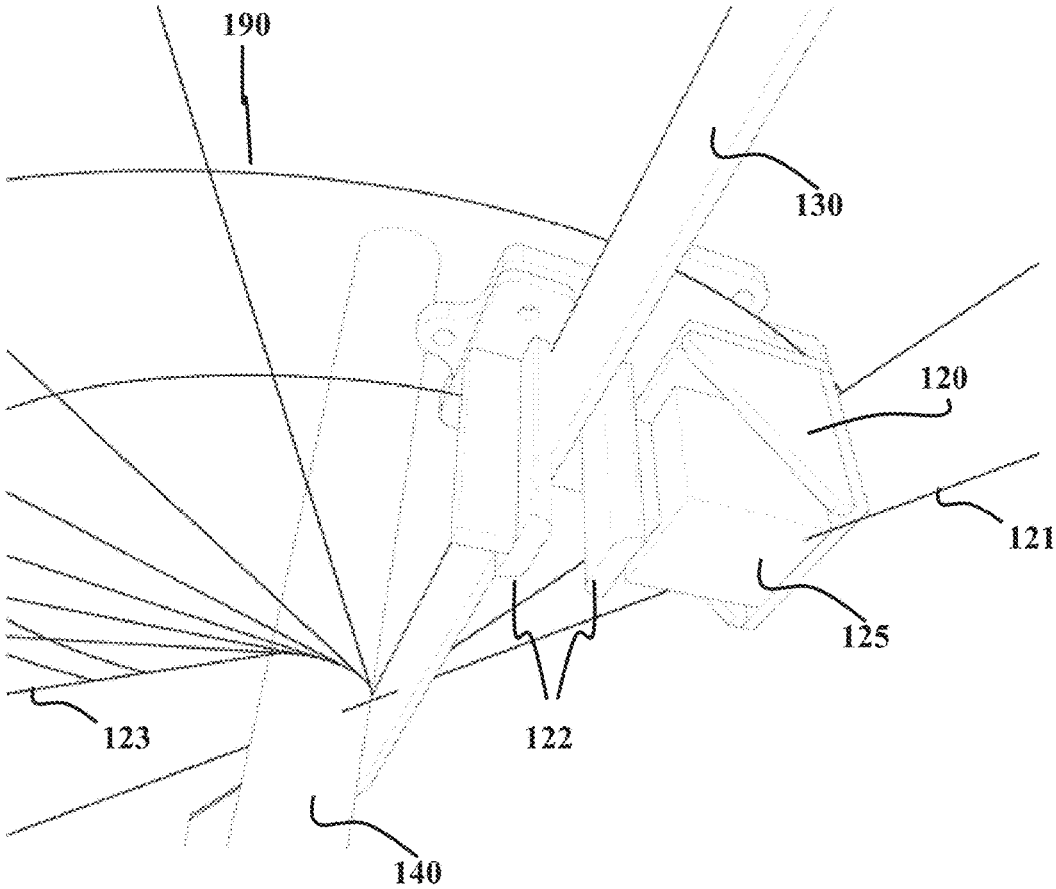
FIG. 3 depicts a gripper at the end of a robotic arm.
Figure 7:
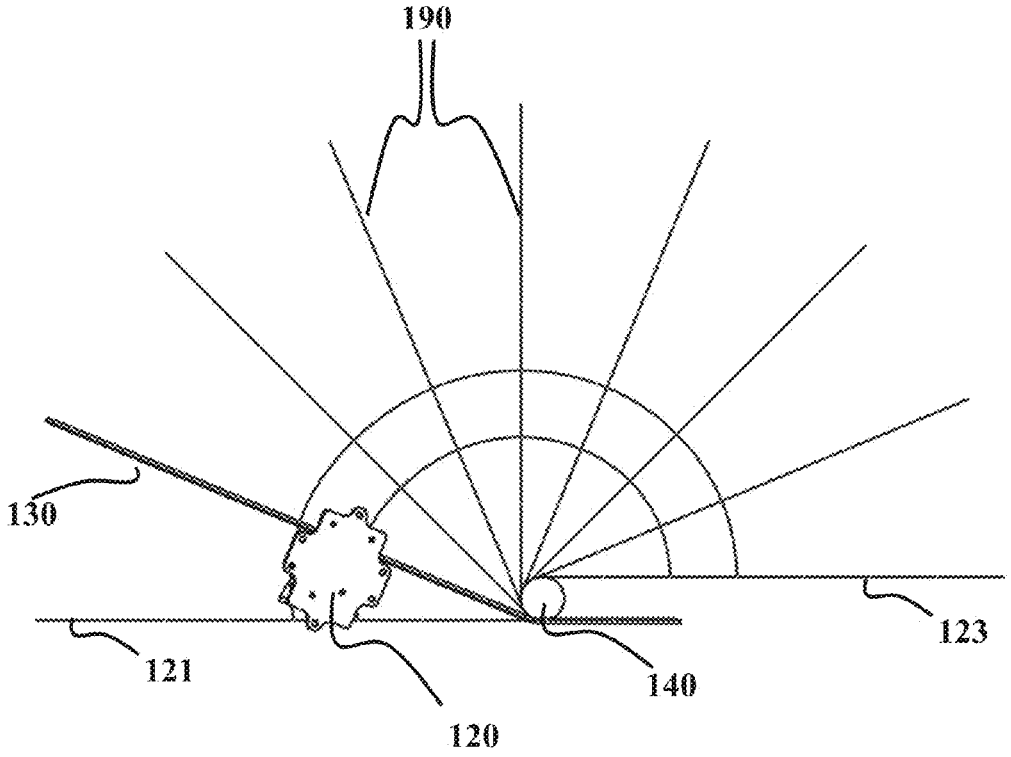
FIG. 7 illustrates a top view of the involute robotic path of the gripper.
Figure 8:
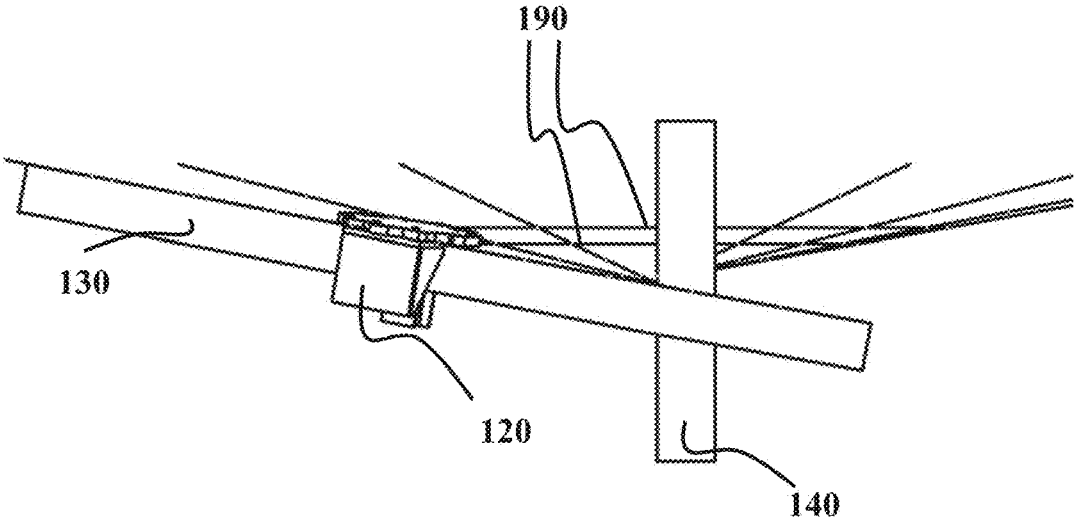
FIG. 8 illustrates a side view of the involute robotic path of the gripper.

At the beginning of the bending process, the gripper 120 on the end of the robot arm 110 grasps the straight wood strip 130 near one of the ends. FIG. 3 is an illustration of a gripper 120 grasping the wood 130. The gripper 120 is formed from two opposing plates 122. Preferably, the surfaces of the plates 122 facing the board 130 are covered by a soft material, e.g., rubber, to prevent damage to the wood 130. The opening and closing the plate 122 is accomplished via pneumatics 125. In a closed position, the plates 122 firmly hold the wood so that there is no slippage or unintended movement during the manipulation of the robot arm 110 during the bending process. The end of the arm 110 on which the grippers are disposed is preferably capable of rotation to assist in the bending process. 190 illustrates a 2 curve involute robotic path describing orientation of gripper 120. Line 121 illustrates zero degrees of rotation in a bend, while 123 represents 180 degrees. FIG. 7 illustrates a top view of the involute robotic path of gripper 120, while FIG. 8 illustrates a side view. In FIG. 8, wood strip 130 in this schematic has 22 degrees of rotation and a 15 degree bending angle.

During the bending process, one surface of the wood strip 130 makes direct contact with the hot pipe 140. As shown in FIG. 1, the friction plate 150 presses against the opposite surface of the wood strip 130 to urge it against the hot pipe 140. The main reason for opening and closing friction plate 150 is to allow gripper 120 to disengage while the strip 130 is fixed by friction plate 150 to relocated gripper 120 to the next bending position of strip 130. As with the gripper plates 122, the friction plate 150 is preferably covered in a soft material, e.g., rubber, to prevent scratching, discoloring or otherwise damaging the surface of the wood strip 130. The heat from the hot pipe 140 causes the lignin in the wood 130 to plasticize. The wood surface directly in contact with the mandrel 140 contracts, adding to the success of the bending process. This plasticization allows the fiber to reorient and a new overall form for the strip to be created, i.e., bends. Controlling the temperature of the bending pipe 140 affects the structural integrity of the wood 130. When wood is burnt, the strip 130 loses its structural capacity. Sufficient heat is generated to plasticize the lignin without producing any material degradation. Depending on the type and thickness of the wood strips 130, the mandrel is controlled to a temperature between 150° F. and 380° F. and preferably above 200° F. These temperatures generate enough heat to plasticize the lignin in the wood strips 130 without producing any material degradation. Ultimately, hot iron bending is a successful fabrication strategy because it approaches the task locally, achieving quality bends from an anisotropic material. The precise temperatures for any particular bending operation can be determined by routine tests in conjunction with the imposition of any particular time limitations. The temperature and time parameters can be selected as desired for the production operation.

For the first preprogrammed bend in the strip 130, the gripper 120 grasps a portion of the strip 130. With the board 130 firmly grasped, the arm 110 positions the board 130 at the preprogrammed position and preprogrammed angle (with respect to the horizontal, or vertical) with one face of the board 130 contacting the hot pipe 140. The friction plate, as described above, urges the board 130 against the pipe 140. For a typical $3/8^{th}$ thick strip 130, the time required to perform a bend is approximately two minutes. The robot can be equipped with a pressure sensor to automatically determine bending speed. Without a pressure sensor one can determine bending speed by manually test bending the material. After the preprogrammed amount of curvature has been achieved in the board [the board remains in that position against the mandrel 140 for an additional two minutes to ensure the reorientation of the fibers is complete and until visually the moisture of the wood 130 around the mandrel 140 has evaporated.

After a first preprogrammed bend in the wood strip 130 is completed, the friction plate 150 releases. If there is another bend to be made on the strip 130, the robot reorients the strip 130 in the friction plate 150 based on desired bending angle and location. Sometimes an external gripper can be used to hold the strip 130 so that the robot gripper 120 can reposition on the strip 130 at the proper place and angle for next preprogrammed bend spacing. This process of gripping, positioning, bending, drying and re-gripping and repositioning, bending is repeated for each of the preprogrammed bends of the board 130.

The size and the shape of the mandrel 140 is a matter of choice by the artisan. The mandrel can be cylindrical, oval, conical or any other shape, preferably one with a curved surface. If the mandrel 140 has an oval, elliptical or irregular closed curve cross section, the mandrel 140 can be designed to rotate to a specific position to allow for different radius bends without manually changing the mandrel 140. The diameter of the mandrel 140 determines the tightness of the curves that can be produced. For example a smaller diameter mandrel 140 creates tight curves with a small radii. Larger diameter mandrels 140 create more gentle curves with larger radii. Wood strips 130 with a greater thickness requires a greater radius mandrel 140.

Figure 4:
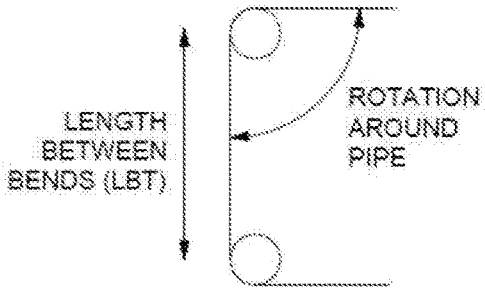
FIG. 4 illustrates a multiple mandrel embodiment.
Figure 4:
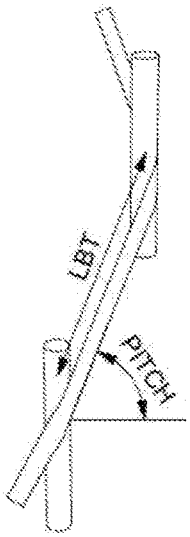
Figure 4:
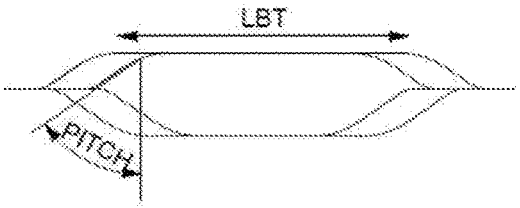
Figure 4:
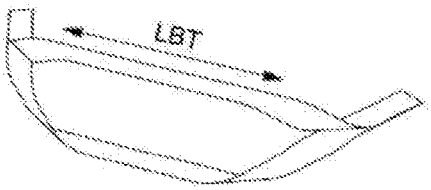
Figure 4:
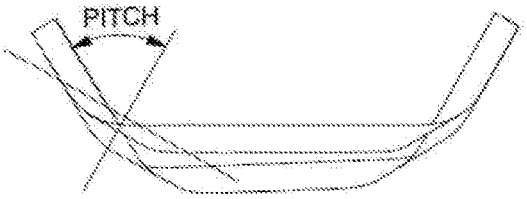
Figure 4:
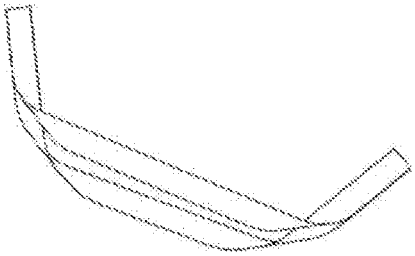

As appreciated by those skilled in the art, the system of the present invention can include several mandrels 140 for simultaneous or serial bending of wood strips 130 as illustrated in FIG. 4. As with a single mandrel system, in which the mandrel 140 can be swapped out for a mandrel 140 of a different shape (conical for cylindrical) or switched out for a mandrel 140 of a different diameter, the multi-mandrel embodiment of FIG. 4 can use several different sized and shaped mandrels 140 to provide efficient and varied bends in a wood strip 130. The multi-mandrel embodiment can include one or more robot arms 110 to perform the bending. In a single arm 110 embodiment, the mandrels 140 can be positioned sufficiently close, the arm 110 can articulate such that it can perform the bending manipulation of the board 130 around multiple mandrels 140. Alternatively, as described above, the arm 110 is mounted on a rail 160 and can travel transversely to position itself for bending on several mandrels 140. Further, the system can be provided with several arms 110, one for each or several mandrels. In a highly automated embodiment, for volume production, each arm 110 can perform one specific bend on a dedicated mandrel.

Figure 5:
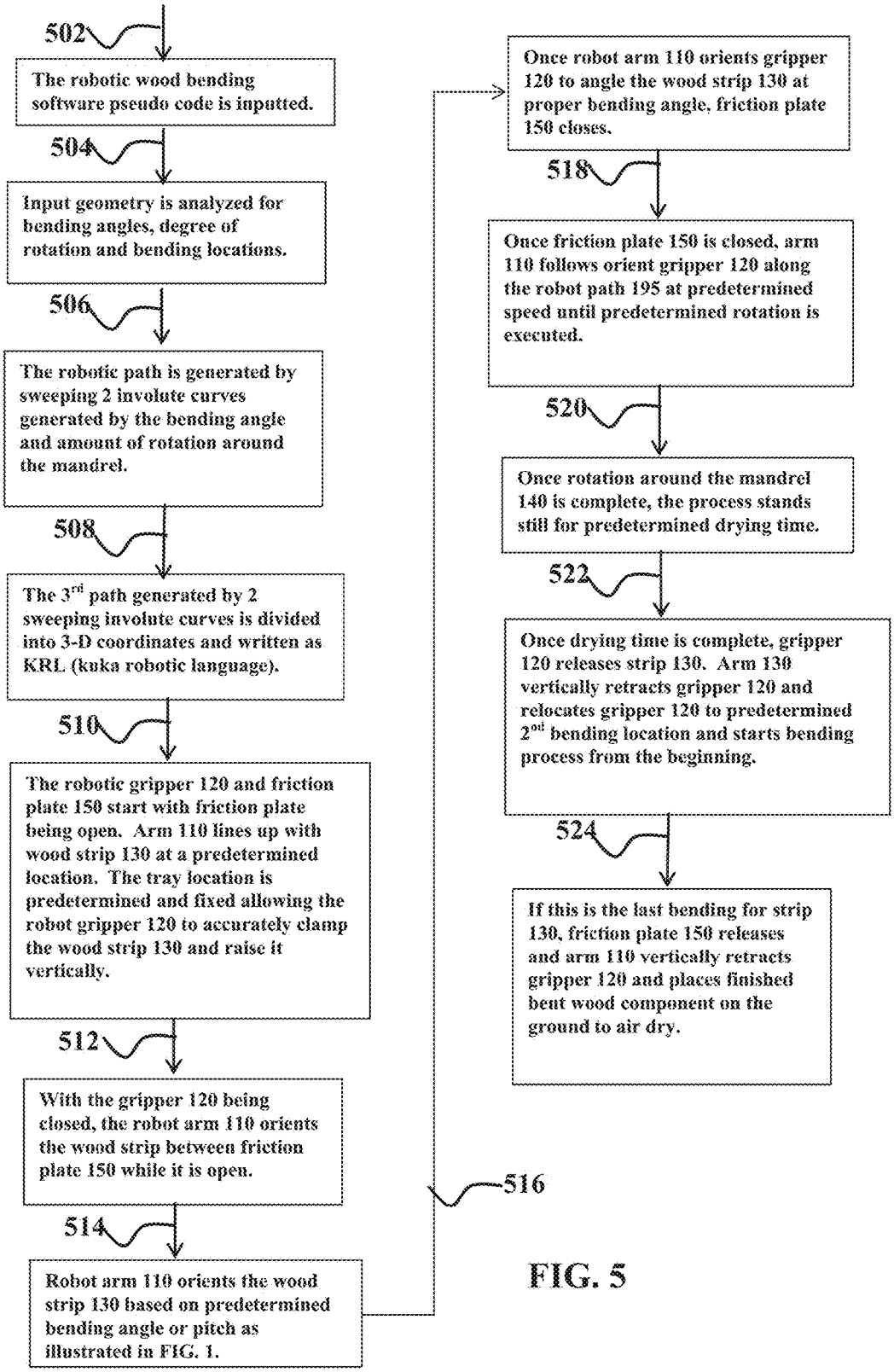
FIG. 5 is a flow chart illustrating the operation of the robotic arm.

Now the principle of translation of the artist's 3 D geometric shapes into robotic code and operation of the robotic arm will be described referring to FIG. 5. The operation is initiated by inputting the software pseudo code in step 502. At step 504, the inputted geometry is analyzed for bending angles, degree of rotation and bending locations. At step 506, the robotic path is generated by sweeping two involute curves generated by the bending angle and amount of rotation around the mandrel. In step 508, the 3rd path generated by two sweeping involute curves is divided into 3D coordinates and written as kuka robotic language. This is followed by the robotic gripper 120 and friction plate 150 being in an open configuration. Arm 110 lines up with wood strip 130 at a predetermined location. The tray location is predetermined and fixed allowing the robot gripper 120 to accurately clamp the wood strip 130 and raise it vertically, which is illustrated in step 510. At step 512, with the gripper 120 being closed, the robot arm 110 orients the wood strip between friction plate 150 while it is open. In step 514, robot arm 110 orients the wood strip 130 based on predetermined bending angle or pitch as further illustrated in FIG. 1. Once robot arm 110 orients gripper 120 to angle the wood strip 130 at proper bending angle, friction plate 150 closes as illustrated in step 516. Once friction plate 150 is closed, arm 110 follows orient gripper 120 along the robot path 195 at predetermined speed until predetermined rotation is executed as depicted at step 518. Step 520 demonstrates that once rotation around the mandrel 140 is complete, the process stands still for predetermined drying time. Once drying time is complete, gripper 120 releases strip 130. Arm 130 vertically retracts gripper 120 and relocates gripper 120 to predetermined 2nd bending location and starts bending process from the beginning as shown in step 522. If this is the last bending for strip 130, friction plate 150 releases and arm 110 vertically retracts gripper 120 and places finished bent wood component on the ground to air dry, which concludes the operation at step 524.

Figure 6:
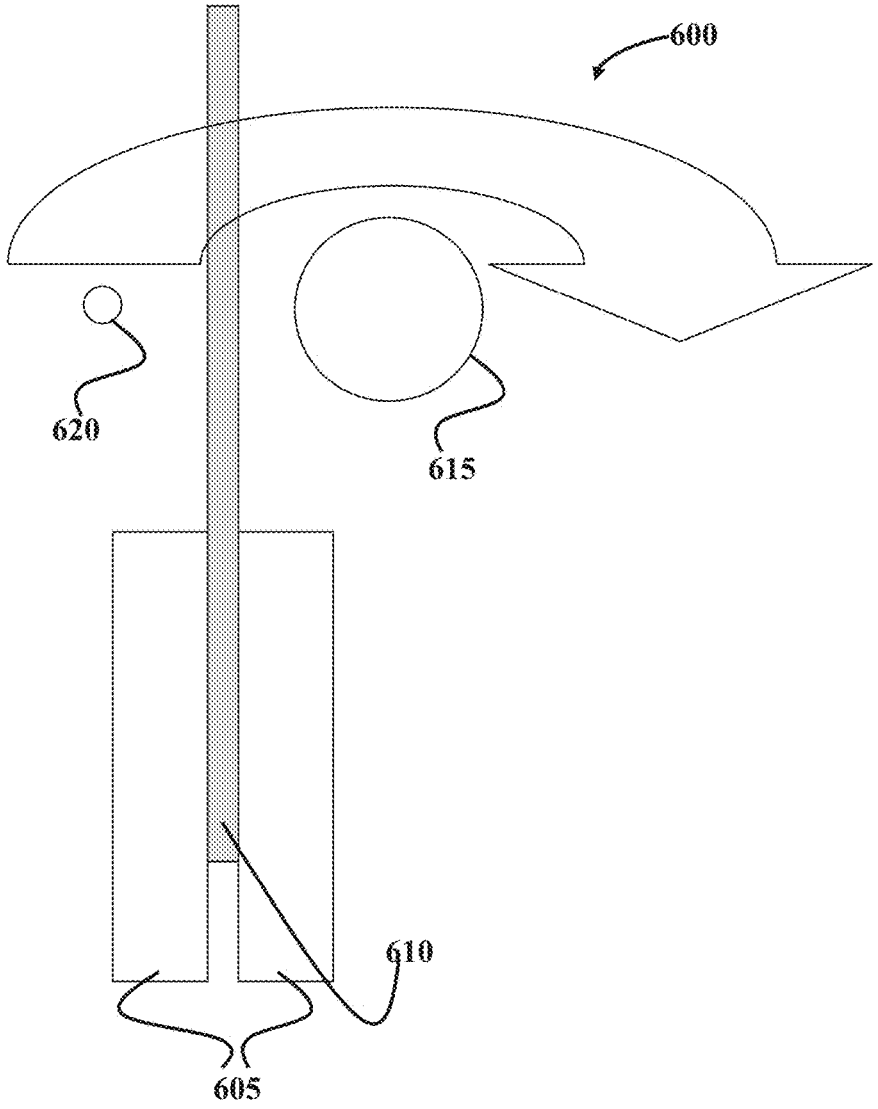
FIG. 6 is a schematic view of another device for bending wood according to the invention.

FIG. 6 illustrates an alternative device for use in the bending wood according to the invention. This device 600 includes a clamp 605 for grasping the end 610 of a wood strip and for moving it forward to adjacent the mandrel 615. After being place in that position, bending arm 620 is pivoted to contact the wood and to urge it against the heated mandrel 615. The clamp 605 angles the wood 130 in relation to the mandrel 615. The clamp 605 urges the wood 130 forward or backward to position the wood 130 correctly for bending.

The bent wood strips 130 can be used for various structural supports in furniture, building construction and other items. When the wood strips 130 are bent into a helical tube, it can be used as is or as a mold to receive and be filled with other material (e.g., cement) to form columns or building supports. The seams of the tubes can be sealed so that the tubes are able to hold or convey liquids. The seams can be formed by adding glue to the ends of the strips as they are bent and contact an adjacently bent strip or the glue or adhesive can be applied during bending. There are no limits on the uses of the variously configured bent wood strips and designers can create all types of structures using the systems and methods of the invention.

Although the present invention has been described in relation to particular embodiments thereof, many other variations and other uses will be apparent to those skilled in the art. As noted herein, a robotic system is preferred but the invention is operable with another automated or semi-automated device that can grab and hold the wood strips as they are bent around the mandrel. It is also possible to hold the wood stationary and have the mandrel move to cause the wood 130 to bend. Therefore, that the present invention be limited not by the specific disclosure herein, but to also cover all other modifications that fall within the true spirit and scope of the disclosure.

What is claimed is:

1. An automated process for bending wood into a bent structure, which comprises:

grasping a water saturated wood strip by a holding member;

contacting the held water saturated wood strips with a heated mandrel for a sufficient time and with sufficient pressure to reorient fibers in the water saturated wood strips to fix or lock the wood strip in a desired bent configuration, wherein the wood strips are applied to contact the mandrel at an angle of between 30 and 150, and removing the wood that is fixed or locked in the bent configuration;

wherein the grasping, contacting and removing steps are automatically conducted under computer control of the holding member and mandrel to obtain the bent structure;

wherein the holding member is a preprogrammed automated robot arm that is fitted with a gripper for grasping and manipulating the wood strip around the heated mandrel in order to bend the wood into the desired bent configuration.

2. The process of claim 1 wherein the water saturated wood strip is obtained by soaking the wood in water for a sufficient time to saturate the wood fibers therein and render the wood strip pliable and conducive to being bent.

3. The process of claim 1 wherein the mandrel is heated to a temperature of between approximately 150° F. and 380° F.

4. The process of claim 1 wherein the computer control is operatively associated with the holding member; for controlling operation of the system; wherein the computer control causes the holding member to automatically grasp the wood strip, cause contact with the heated mandrel and remove the wood strip after it is fixed or locked in the bent configuration to obtain the bent structure.

5. The process of claim 4, wherein the bent structure that is obtained has a helical configuration, and is prepared as a structural element.

6. The process of claim 5, which further comprises incorporating one or more of the structural elements in furniture or building construction.

7. The process of claim 6, which further comprises bending the wood strip into a helical tube.

8. The process of claim 6, which further comprises filling the tube with another material.

9. The process of claim 6 which further comprises sealing the tube by adding glue to ends of the tube as the wood strip is bent.

10. The process of claim 1, wherein the wood strip is saturated with water only in the portion that is to be bent and not in the entire strip.

11. The process of claim 10, wherein the ends of the wood strip form an angle of about 135° with respect to each other after being bent.

12. The process of claim 10, wherein the ends of the wood strip form an angle of 90° after being bent to form a U-shaped bent part.

13. The process of claim 10, wherein the wood strips are bent with incremental bends to create continuous curving strips similar to the shape of the letter S by providing several bends formed close together with non-bent areas between the bent portions.

14. The process of claim 1, wherein the wood strip has a flat relatively straight configuration and is bent around the mandrel at an angle other than perpendicular to provide a somewhat spiral curved shape to the wood strip.

15. The process of claim 1, wherein the wood strip is initially formed in the shape of an arc and is bent around the mandrel at an angle other than perpendicular to provide a somewhat spiral curved shape to the wood strip.

16. The process of claim 1, wherein the wood strip has an initially curved configuration and is bent perpendicularly around the mandrel in multiple locations along the wood strip to provide a somewhat spiral curved shape.

17. The process of claim 1, wherein the bending of the wood strips, the generation of a particular final form, and computer code for moving the swing arm or friction plate create a feedback loop which provides updated code for generating and analyzing geometries and controlling subsequent bending operations.

* * * * *